US006400315B1

(12) United States Patent
Adler et al.

(10) Patent No.: US 6,400,315 B1
(45) Date of Patent: Jun. 4, 2002

(54) CONTROL SYSTEM FOR ELECTRONICALLY SCANNED PHASED ARRAY ANTENNAS WITH A MECHANICALLY STEERED AXIS

(75) Inventors: Charles Otis Adler, Renton; Jeffrey Kim Cunningham; Matthew Edward Lavelle, both of Seattle, all of WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/620,487

(22) Filed: Jul. 20, 2000

(51) Int. Cl.[7] ..... H01Q 3/00
(52) U.S. Cl. ..... 342/359; 342/427
(58) Field of Search ..... 342/74, 359, 372, 342/427

(56) References Cited

U.S. PATENT DOCUMENTS

| | | | | |
|---|---|---|---|---|
| 3,972,045 | A | | 7/1976 | Perret |
| 4,392,139 | A | | 7/1983 | Aoyama et al. |
| 4,743,906 | A | | 5/1988 | Fullerton |
| 4,866,515 | A | | 9/1989 | Tagawa et al. |
| 4,901,307 | A | | 2/1990 | Gilhousen et al. |
| 4,958,381 | A | | 9/1990 | Toyoshima |
| 5,127,021 | A | | 6/1992 | Schreiber |
| 5,146,234 | A | | 9/1992 | Lalezari |
| 5,230,076 | A | | 7/1993 | Wilkinson |
| 5,249,303 | A | | 9/1993 | Goeken |
| 5,285,470 | A | | 2/1994 | Schreiber |
| 5,289,272 | A | | 2/1994 | Rabowsky et al. |
| 5,311,302 | A | | 5/1994 | Berry et al. |
| 5,313,457 | A | | 5/1994 | Hostetter et al. |
| 5,463,656 | A | | 10/1995 | Polivka et al. |
| 5,495,258 | A | | 2/1996 | Muhlhauser et al. |
| 5,524,272 | A | | 6/1996 | Podowski et al. |
| 5,555,466 | A | | 9/1996 | Scribner et al. |
| 5,568,484 | A | | 10/1996 | Margis |
| 5,583,735 | A | | 12/1996 | Pease et al. |
| 5,760,819 | A | | 6/1998 | Sklar et al. |
| 5,790,175 | A | | 8/1998 | Sklar et al. |
| 5,801,751 | A | | 9/1998 | Sklar et al. |
| 6,034,634 | A | | 3/2000 | Karrisson et al. |
| 6,047,165 | A | | 4/2000 | Wright et al. |
| 6,104,914 | A | | 8/2000 | Wright et al. |
| 6,108,523 | A | | 8/2000 | Wright et al. |
| 6,111,542 | A | * | 8/2000 | Day et al. ..... 342/359 |
| 6,124,832 | A | * | 9/2000 | Jeon et al. ..... 343/711 |
| 6,266,011 | B1 | * | 7/2001 | Hong ..... 342/375 |

* cited by examiner

*Primary Examiner*—Dao Phan
(74) *Attorney, Agent, or Firm*—Harness Dickey & Pierce P.L.C.

(57) ABSTRACT

A control system for maximizing performance of an electronically scanned, mechanically augmented phased array (MAPA) antenna. In one preferred form, the control system forms a closed loop system which monitors a signal quality of the received signal from a primary signal source such as a primary satellite, and generates motor control signals for controlling a motor used to rotate the MAPA antenna about an axis so as to point the antenna at least slightly away from the primary signal source while electronically steering the antenna to track the primary signal source. The MAPA antenna is positioned so as to maximize the carrier-to-noise-plus-interference (CNI) ratio, and thus minimize the influence of interfering signal sources operating within a coverage region of the MAPA antenna. Open loop control arrangements are also described which make use of look-up tables or assumptions on the positions of interfering signal sources for generating motor control signals to position the MAPA antenna in desired orientations to limit the reception of signals from interfering signal sources.

12 Claims, 4 Drawing Sheets

CONTROL SYSTEM FOR ELECTRONICALLY SCANNED PHASED ARRAY ANTENNAS WITH A MECHANICALLY STEERED AXIS

TECHNICAL FIELD

This invention relates to control systems for electronically scanned, phased array antennas, and more particularly to a control system for an electronically scanned, phased array antenna which is rotatable about at least one axis of movement to enable positioning of the aperture of the antenna so as to maximize the total carrier-to-noise-plus-interference ratio of the signal received by the antenna from a primary signal source when at least one interfering signal source is present in the coverage region of the antenna.

BACKGROUND OF THE INVENTION

Mobile platforms, especially aircraft, require compact, low profile antenna systems. Antennas that offer a combination of mechanical and electronic scanning are used in a number of applications. These antennas usually have a limited aperture size to meet size restrictions. Such size restrictions are often necessary, especially in aircraft, where weight and aerodynamics of the antenna are very important factors. Additionally, these antenna apertures frequently comprise a rectangular configuration due to production and cost considerations. This combination of limited aperture size and rectangular aperture configuration results in both a larger beamwidth and significant beam side lobe "trains" or "ridges" that are oriented along the primary axes of the antenna aperture.

The above-described side lobes are not a significant problem when the antenna is operated with a single source, such as when the antenna is receiving signals from a single satellite transponder within a given coverage region. However, when this type of antenna is operated in an environment where interfering signal sources (i.e., non-primary signal sources) are present, such as when one or more additional satellite transponders are present within the coverage region and in relatively close proximity with the primary signal source (i.e., on the order of several beamwidths), then the orientation of the antenna side lobes is critical. A typical control system for this type of antenna uses either navigation data to orient the antenna "broadside" to the satellite transponder being tracked (i.e., to the primary signal source) or uses a closed-loop, received power maximizing approach to achieve the same result. Either approach can have the effect of lining up the side lobe "trains" on the interfering signal sources.

The above-described scenario of an environment with significant interfering signal sources describes the situation for aircraft-type commercial Ku-band antennas operating with the most common (and lowest cost and most available) type of satellite services in this band—those operated on Fixed Satellite Service (FSS) satellites. In this case, for antennas with conventional control systems, the lining up of the sidelobe trains with one or more interfering satellites along the geosynchronous arc can result in a significant loss of performance. This loss of performance is especially exacerbated when the antenna is operated at lower latitudes.

FIG. 1 shows performance estimates for a mechanically augmented phased array (MAPA) antenna with a conventional control system and geographically demonstrates the loss of performance at lower latitudes. Contour $C_7$ represents 7 Mbps. Contours $C_6$–$C_1$ represent 6 Mbps to 1 Mbps in 1 Mbps steps.

FIG. 2 illustrates the case of a bore-sighted (i.e., zero scan angle) main beam. For a rectangular phased array antenna, a key feature is that as the antenna main beam is scanned, corresponding to moving the peak "P" to different points on the illustrated circular grid "G", the sidelobe ridges ("R") move with the main beam while remaining approximately parallel to the principal antenna axes. The location of the axes of the sidelobe ridges with respect to other satellite transponders or signal sources is an important determinant of interference levels. When these antennas are fixed on aircraft, the orientation of the sidelobes is a function of the aircraft's direction of flight and cannot be controlled. When these phased array antennas are able to rotate, such as with a MAPA antenna, the additional degree of freedom can be used to favorably orient these axes with respect to interfering signals. This is in contrast to the traditional approach, which is to turn the antenna to face the satellite transponder (i.e., the primary signal source) as closely as possible in order to reduce scan loss and maximize received radio frequency (RF) power.

Accordingly, it is a principal object of the present invention to provide a control system and method for a MAPA antenna that controls pointing of the antenna aperture 50 that the antenna aperture is pointed not directly at a primary signal source, but rather is pointed at least slightly away from the primary signal source in a controlled manner to minimize the influence of interfering signal sources without significantly adversely affecting the strength of the received signal.

It is another object of the present invention to provide a MAPA antenna which is controlled by a control algorithm which monitors the signal quality of the signal received by the antenna and controls the positioning of the MAPA antenna in accordance with the determined signal quality, in a closed loop fashion, to minimize the influence of interfering signal sources within the coverage region of the antenna.

It is still another object of the present invention to provide a MAPA antenna wherein the position of the antenna is controlled by an open loop control system making use of a look-up table including antenna position coordinates for positioning the antenna at relatively precise positions based on prior known locations of interfering signal sources.

SUMMARY OF THE INVENTION

The above and other objects are provided by a control system and algorithm for use with a MAPA antenna to control pointing of the antenna aperture in a manner to minimize interference from non-primary signal sources operating within a coverage region of the antenna while the antenna is receiving signals from a primary signal source, and without significantly reducing the signal strength of the received signal. In one preferred form, a closed loop control algorithm is provided for determining the optimum positioning of the MAPA antenna to reduce the influence of interfering signal sources. This algorithm accomplishes rotation of the MAPA antenna off axis to point the antenna sub-optimally in terms of scan angle loss, but which provides significant gains in terms of reduced interference, thus resulting in overall improved antenna performance.

The closed loop algorithm approach makes use of a measure of signal quality of the received signal to control a motor used for positioning the MAPA antenna. Electronic steering of the MAPA antenna is accomplished using traditional power feedback or open-loop pointing methods. The signal quality may be represented by various factors, but in one preferred embodiment is represented by the bit error rate ("BER") of the received signal. The BER is monitored and the MAPA antenna aperture's face is rotated at least slightly away from the primary signal source while at the same time electronically steering the antenna beam back on target to the primary signal source with a conventional beam steering controller. Monitoring the BER makes it possible to maximize the total carrier-to-noise-plus-interference ("CNI") ratio of the received signal, and thus significantly limit the influence of interfering signal sources.

In an alternative preferred form of the present invention, an open-loop control system is employed for controlling positioning of a MAPA antenna. This embodiment makes use of look-up tables incorporating pre-calculated antenna position information based on the positions of known, interfering signal sources within a coverage region. Longitude and latitude information of the moving platform (i.e., aircraft or ship) is used by the control system in this embodiment to determine optimal antenna positions (i.e., azimuthal positions) from the look-up tables so that pointing of the MAPA antenna is accomplished in a manner that minimizes interference from the interfering signal sources.

In another alternative preferred embodiment, an open loop control system is employed which makes use of real-time calculations using a simplified model of the positions of likely interfering signal sources. With this approach, it is assumed that the worst interfering, non-primary signal sources will lie approximately along the line of the normal to the geostationary arc at the longitude of the primary signal source being tracked. This normal line is calculated using suitable equations for calculating the horizontal axis angle of the primary signal source in antenna system coordinates. The MAPA antenna is then rotated to an orientation that puts this line off of the primary axes for the sidelobes of the MAPA antenna.

In each of the above-described embodiments, the antenna aperture is physically pointed not directly at the primary signal source, but rather at least slightly away from the primary signal source and then the beam is electronically steered to track the primary signal source. The pointing of the antenna at least slightly away from the primary signal source, but in a direction that minimizes the influence of signals received from interfering signal sources on the sidelobe trains of the antenna thus serves to maximize the CNI ratio of the received signal from the satellite being tracked.

BRIEF DESCRIPTION OF THE DRAWINGS

The various advantages of the present invention will become apparent to one skilled in the art by reading the following specification and subjoined claims and by referencing the following drawings in which:

FIG. 6 is a simplified data flow diagram for an open loop control system in accordance with an alternative preferred embodiment of the present invention.

DETAILED DESCRIPTION OF THE PREFERRED EMBODIMENTS

Figure 1:
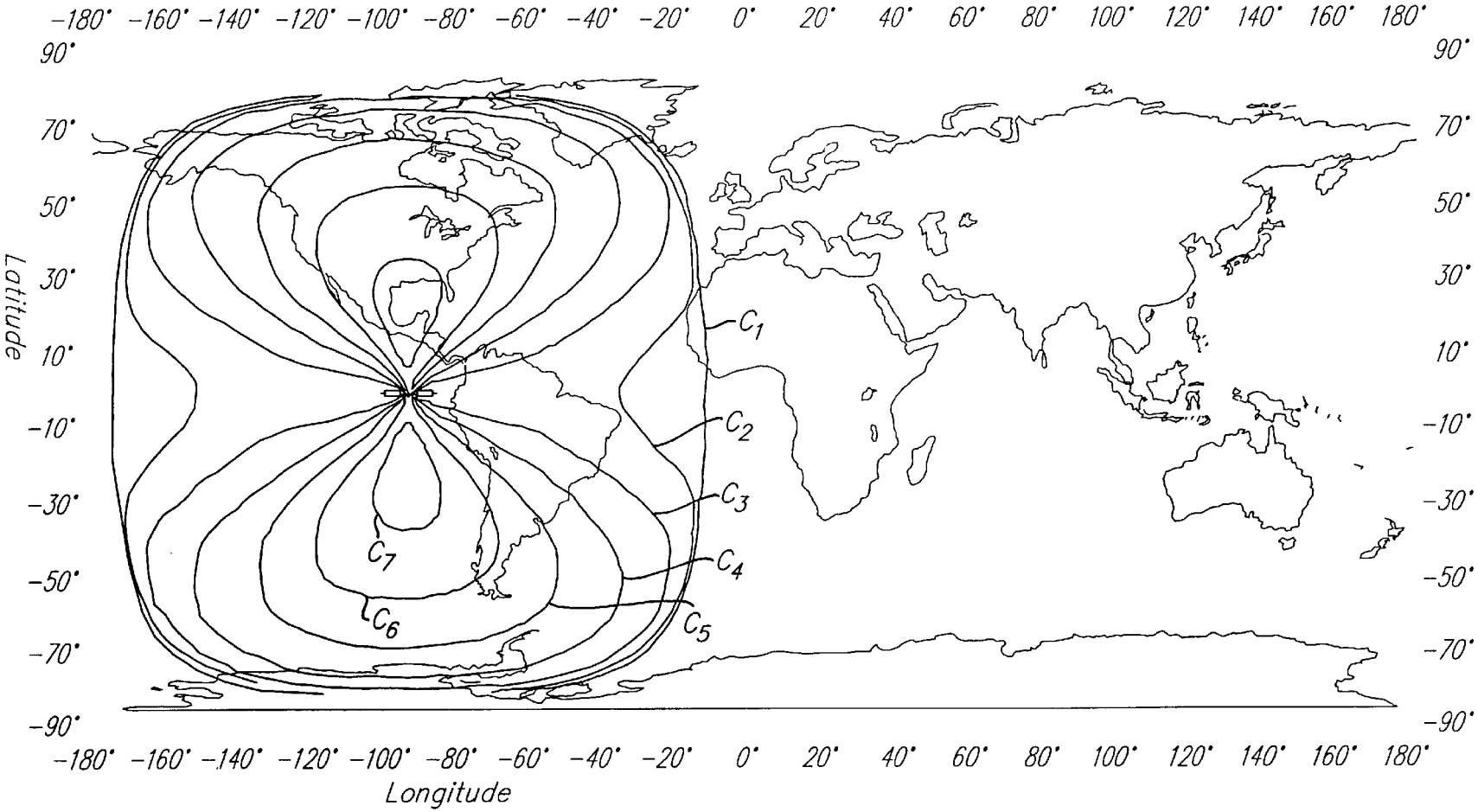
FIG. 1 illustrates performance estimates for a MAPA antenna with a conventional control system and demonstrates the loss of performance at lower latitudes.
Figure 2:
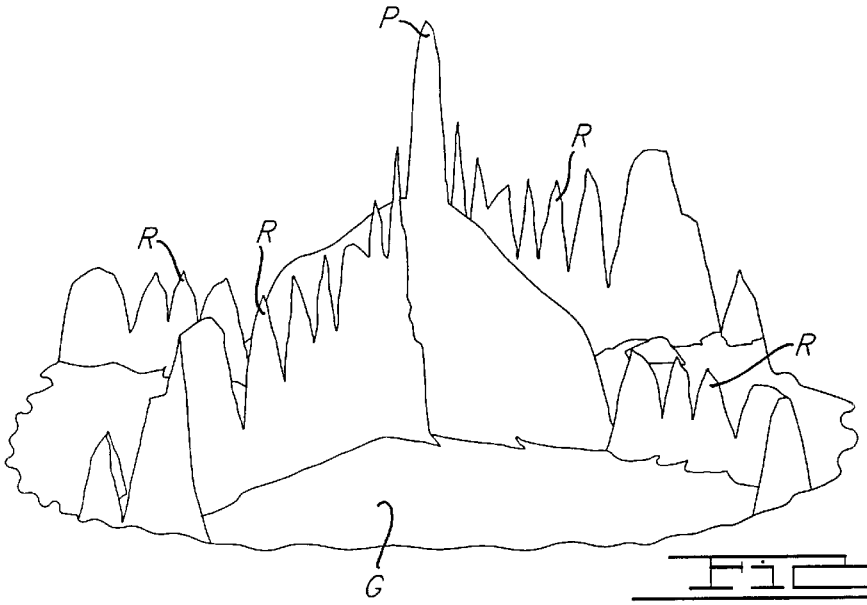
FIG. 2 illustrates a boresighted (i.e., zero scan angle) main beam for a rectangular phased array antenna showing the locations of the sidelobe ridges in relation to the main beam.
Figure 3:
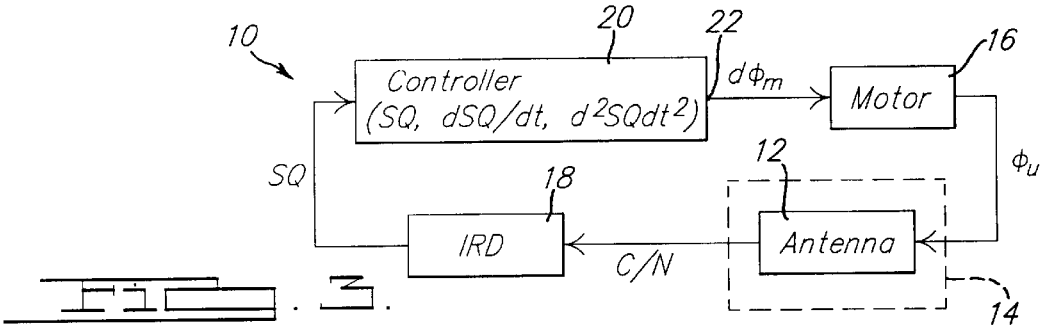
FIG. 3 is a simplified data flow diagram for a closed loop control system in accordance with a preferred embodiment of the present invention.

Referring to FIG. 3, there is shown a data flow diagram 10 for implementing a closed loop control system to control positioning of an electronically steerable, mechanically augmented phased array (MAPA) antenna 12. The MAPA antenna 12 is positioned on a turntable or other suitable structure 14 so that it is moveable about at least one axis. A motor 16 is used for turning the turntable 14. In the preferred embodiments described herein, the MAPA antenna 12 is rotatable in the azimuthal plane.

An integrated receiver/decoder (IRD) 18 is used to receive signals from the MAPA antenna 12 and to provide signals therefrom relating to a signal quality ("SQ") of the received signals to a controller 20. The controller 20 uses the signal quality signals to generate motor control signals at an output 22 which are applied to the motor 16. The motor control signals cause the motor 16 to position the turntable 14 such that the MAPA antenna 12 is pointed at least slightly off-axis, in the azimuthal plane, from a primary signal source being tracked by the MAPA antenna 12. The positioning of the MAPA antenna 12 by the motor 16 is further such as to place the MAPA antenna in a position where the sidelobes of the antenna are not susceptible to RF signals from interfering signal sources operating within the coverage region of the MAPA antenna 12. Positioning of the MAPA antenna aperture 12 such that its boresight is directed away from the primary signal source is performed while the antenna beam is electronically steered to track the primary signal source. In this manner, the CNI ratio of the received signal from the primary signal source is maximized.

In practice, an estimate of CNI is needed in order to close a control loop in the above-described fashion. One such estimate of CNI which can be used is the bit error rate (BER) of the received signal from the primary signal source. It should be noted that the simple use of the power level of the received RF signal from the primary signal source will not suffice because this does not discriminate between signal carrier and noise or interference power. In fact, the use of received RF power results in "broadsiding" the MAPA antenna aperture on the primary signal source (i.e., the traditional control approach). Thus, BER or another measure of signal quality is needed. BER information is available from virtually all commercial integrated receiver/decoders, and in the drawing of FIG. 3 is provided by IRD 18.

In addition to the potential for minimizing interference due to signal sources with co-polarization signals, this approach also minimizes interference from cross-polarization signals. This is due to the highly directional nature of the MAPA antenna's 12 axial ratio and, in particular, to the highly scalloped variation in axial ratio at high scan angles which leads to an azimuthal dependence for cross-polarization interference. For a mix of co-polarization and cross-polarization interference, the control algorithm used would optimally choose an orientation for the MAPA antenna 12 which minimizes the total energy received by both.

Referring further to FIG. 3, the turntable 14 is positioned by the motor 16 which is controlled by an algorithm using a measure of the signal quality or BER for feedback. This algorithm can take the form of any of a number of commonly used closed loop control schemes. Examples include using 'PID' type controls with a reference (target) SQ or BER level, gradient following methods that will seek to minimize or maximize the fed-back SQ or BER level, or dithering methods similar to conical scanning or sequential lobing using the mechanical axis.

An example of one suitable closed loop algorithm is represented by the following formula:

$$\delta\phi_K=\delta\phi_{K-1}+(K_p+K_{it}T/2+K_{dt}/T)\ SQerror_K-(K_p+2K_{dt}/T-K_{it}T/2)\ SQerror_{K-1}+(K_{dt}/T)SQerror_{K-2}$$

where:

| | | |
|---|---|---|
| $\delta\phi_K$ | = | Change in rotation angle of mechanical degree of freedom (for turntable 14) for current sample period K |
| $\delta\phi_{K-1}$ | = | Change in rotation angle of mechanical degree of freedom (for turntable 14) for sample period K-1 |
| SQerror | = | Signal Quality (or BER) error = SQ − $SQ_{reference}$ |
| $SQerror_k$ | = | Signal Quality (or BER) error for current sample (K) |
| $SQerror_{k-1}$ | = | Signal Quality (or BER) error for sample K-1 |
| $SQerror_{k-2}$ | = | Signal Quality (or BER) error for sample K-2 |
| $K_{it}$ | = | Integral gain constant |
| $K_p$ | = | Proportional gain constant |
| $K_{dt}$ | = | Derivative gain constant |
| T | = | Time Interval between SQ samples |

Eqn 1.)

The above described algorithm enables a closed loop control system to be constructed which is based on the BER or other form of signal quality for control of the motor 16 to permit precise positioning of the MAPA antenna 12 as needed to maximize the CNI ratio of the received RF signal.

Figure 4:
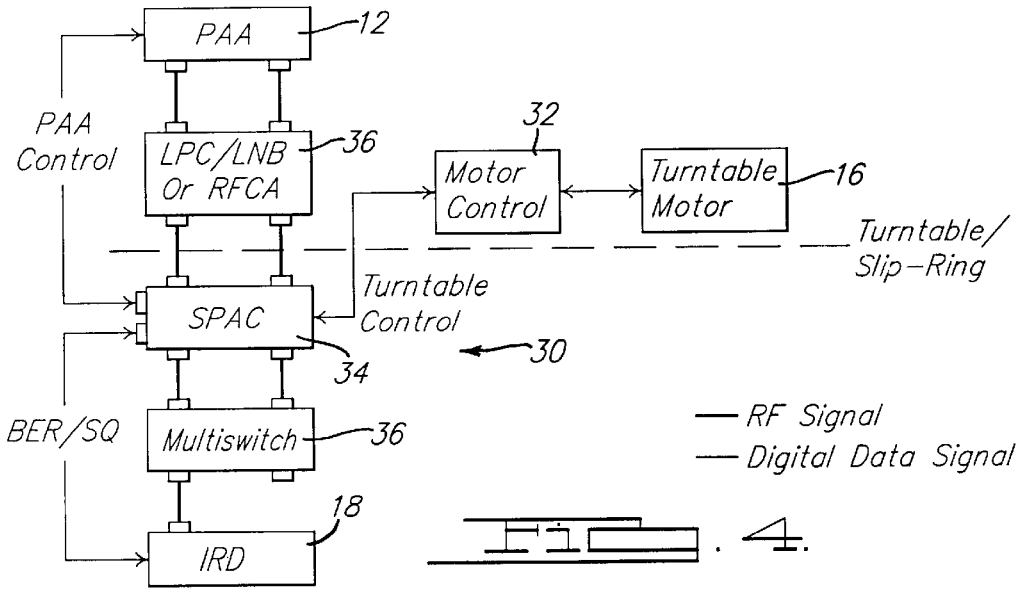
FIG. 4 is a simplified block diagram of a closed loop MAPA antenna positioning system in accordance with a preferred embodiment of the present invention.

Referring to FIG. 4, a closed loop control system 30 for implementing the above-described closed loop control arrangement is shown. A motor control circuit 32 receives signals from a system phased array controller ("SPAC") 34. The SPAC 34 is used to provide power based beam control signals to the MAPA antenna 12 to electronically steer the antenna 12 such that the antenna tracks the primary signal source.

The broadcast signals from the primary signal source are received by the MAPA antenna 12 and input to a Linear Polarization Converter/Low Noise Block Amplifier (LPC/LNB) or radio frequency converter assembly (RFCA) 36. The LPC/LNB 36 performs amplification and frequency shifting of the received RF signal and then passes the RF signal on to the SPAC 34.

The RF signal is then passed on to a multiswitch unit 36 where the appropriate polarity of signal is provided to the IRD 18. The IRD de-modulates the signal into a digital bitstream and then decodes the bitstream. In the process of decoding, error correction codes enable determination of the number of errors introduced into the signal (i.e., the BER) or some other measure of signal quality. Since interfering signal sources increase the number of errors, the BER or other signal quality information can be used to steer the mechanical axis of the MAPA antenna 12 to optimally orient the antenna 12 with respect to interfering signal sources.

Figure 5:
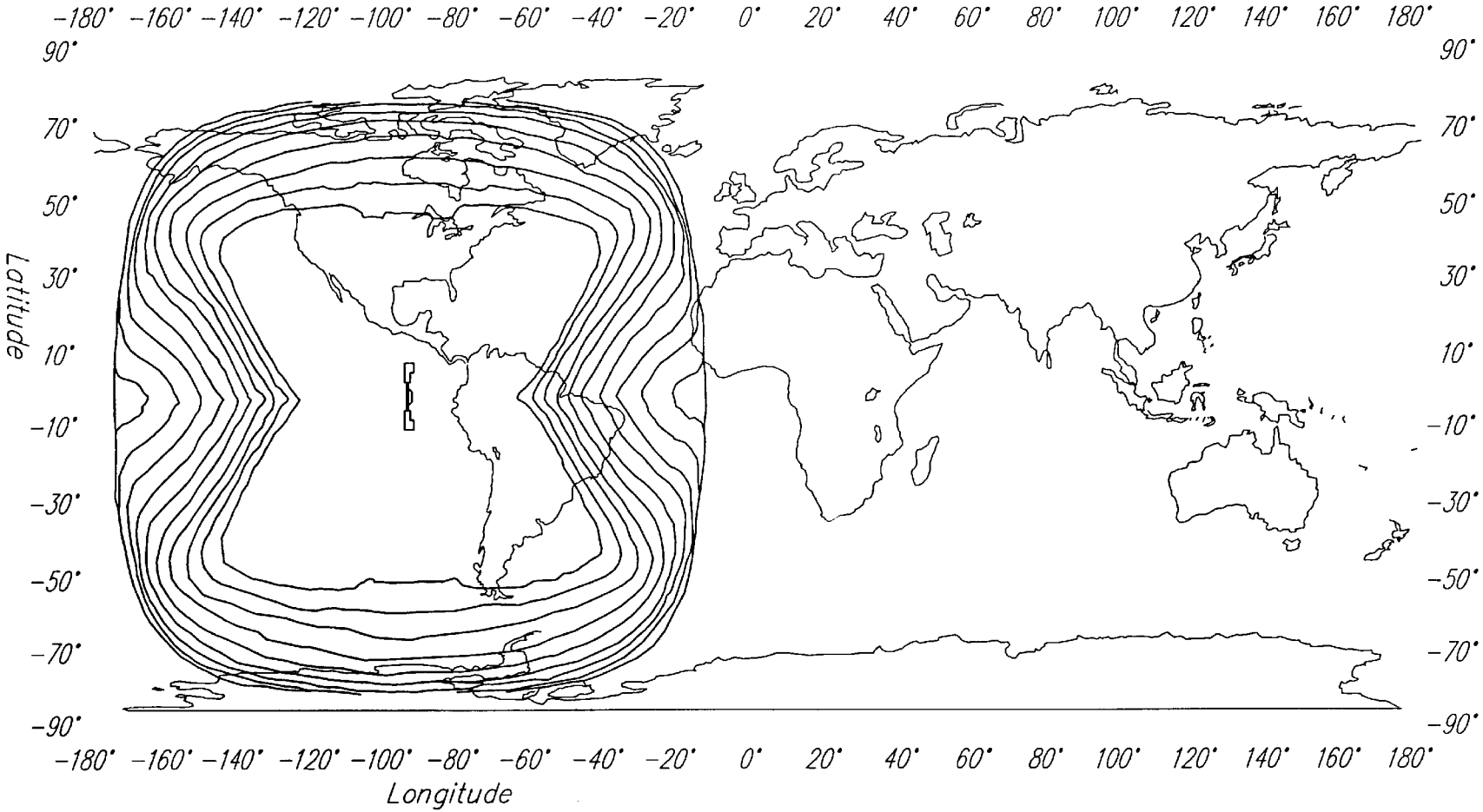
FIG. 5 is a graph illustrating performance estimates for a MAPA antenna controlled in accordance with the control system of the present invention, illustrating the relative gain in performance of the MAPA antenna at lower latitudes.
Figure 5:
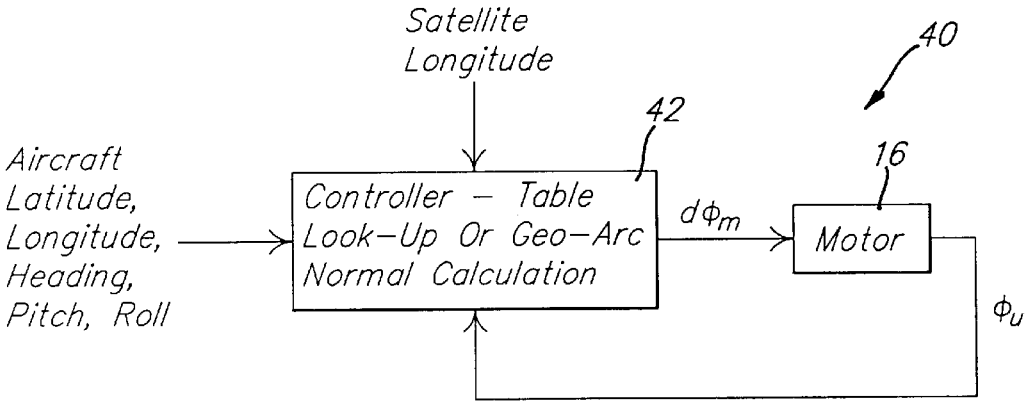

Referring to FIG. 5, the improvement in antenna performance is illustrated with the closed loop control system 30 of the present invention. It will be noted that contours $C_1$–$C_{10}$ increase in one Mbps steps, with the inner contour $C_{10}$ representing 10 Mbps and contour $C_1$ representing 1 Mbps. From FIG. 5 it can be seen that the low latitude performance of the MAPA antenna 12 is significantly improved with the control system 30 because the coverage loss is greatly reduced at the lower latitudes.

Even in the absence of a timely measure of signal quality or BER, it is still possible to improve antenna performance significantly. This factor is important with a transmit antenna because there is no direct feedback in the antenna system from which to make the needed antenna position determinations. With a transmit antenna, it can be equally as important to minimize the interference to those satellite transponders that lie along the geosynchronous arc adjacent to the primary satellite being tracked.

In the case of a geostationary satellite, there are two possible open-loop control approaches that will achieve results similar to the approach described above in connection with FIGS. 3 and 4. Each of these alternative approaches makes use of an open loop control system for determining near optimal antenna orientations without feedback such as signal quality or BER signals. One such control system 40 is illustrated in FIG. 6. This system makes use of the latitude, longitude, heading, pitch and roll of the moving platform (in this example an aircraft) and the longitude of the primary signal source (in this example a satellite). These inputs are fed into a controller 42 having a plurality of look-up tables. The look-up tables contain near-optimal antenna orientations calculated by previous simulations. These look-up tables are used in conjunction with a suitable open-loop electronic tracking algorithm and information from the aircraft's source of navigation and attitude data, such as an Inertial Reference Unit (IRU), GPS or other like system, to determine approximately what the best antenna orientation is. The motor 16 is then commanded to rotate the antenna 12 to this orientation. Previous simulations conducted by the assignee have indicated that performance sensitivity to errors in optimal direction are not significant.

Figure 7:
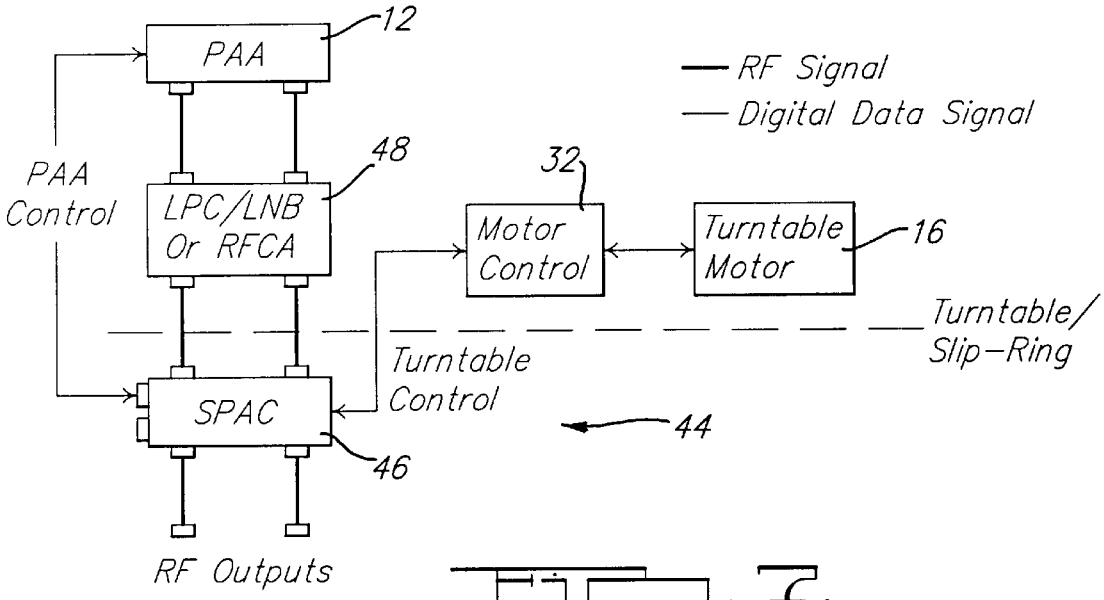
FIG. 7 is a simplified block diagram of an antenna control system for implementing the open loop control system of FIG. 6.

The hardware for implementing the above-described open loop control system of FIG. 6 is illustrated in FIG. 7. The control system 44 of FIG. 7 makes use of a system phased array controller (SPAC) 46 which uses the look-up tables to generate motor position signals which are applied to the motor control circuit 32. The MAPA antenna 12 is electronically steered to track the primary signal source via signals from the SPAC 46, just as with the closed loop control system of FIG. 4. LPC/LNB 48 similarly provides amplification and frequency shifting of the received RF signals and passes these RF signals on to the SPAC 46.

Still another variation of the open loop system of FIGS. 6 and 7 that doesn't rely on look-up tables is one in which it is assumed that the worst interfering signal sources will lie approximately along the line of the normal to the geostationary arc at the longitude of the primary satellite being tracked. This is a simplification of the actual case because for any location not on the equator, the geosynchronous arc is just that—an arc or a parabolic curve. This normal line can be calculated using known equations and methods for calculating a horizontal satellite axis angle in antenna system coordinates. The MAPA antenna 12 is then rotated to a predetermined, optimal azimuthal position that puts this normal line off of the primary axes for the sidelobes of the MAPA antenna 12.

From the foregoing it will be appreciated that the various alternative preferred embodiments described herein enable a MAPA antenna to be positioned in the azimuthal plane such that the face of the antenna aperture is directed away from the primary signal source to a position which significantly reduces the influence of interfering signal sources on the sidelobes of the antenna, while the antenna beam is electronically steered to track the primary signal source. Both open loop and closed loop approaches have been described which enable the antenna to be positioned to avoid the interfering signal sources.

While the above-described preferred embodiments have been described in connection with receive and transmit MAPA antennas, the principles of the present invention could also easily be applied to a receive-transmit antenna (such as a radar antenna) if desired.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method for positioning a electronically steerable, mechanically augmented phased array (MAPA) antenna to track a primary signal source in a manner so as to reduce interference from one or more interfering signal sources operating within a coverage area of said MAPA antenna, the method comprising:

disposing said MAPA antenna on a structure able to be rotated;

receiving a signal from said primary signal source with said MAPA antenna;

determining an optimal signal quality value for said signal received from said primary signal source;

moving an aperture of said MAPA antenna such that a boresight thereof is directed away from said primary signal source, to thereby reduce a signal quality of said signal received by said aperture below said optimum signal quality value.

while said boresight is directed away from said primary signal source, causing a beam of said MAPA antenna to be electronically steered back to track said primary signal source;

monitoring a signal quality of said received signal in real time and generating a signal quality value representative thereof; and moving said aperture of said MAPA antenna to cause said signal quality value to be maintained close to or at said optimal signal quality value.

2. The method of claim 1, wherein said optimal signal quality value comprises a total carrier-to-noise-plus-interference (CNI) ratio value for said received signal.

3. The method of claim 1, wherein signal quality comprises a bit error rate (BER) value.

4. The method of claim 1, using an integrated receiver/decoder to generate said signal quality value.

5. The method of claim 1, wherein said structure supporting said MAPA antenna includes a motor; and wherein said motor is controlled so as to control positioning of said MAPA antenna in accordance with the formula:

$$\delta\phi_K=\delta\phi_{K-1}+(K_p+K_{it}T/2+K_{dt}/T)\ SQerror_K-(K_p+2K_{dt}/T-K_{it}T/2)\ SQerror_{K-1}+(Kd/T)SQerror_{K-2}$$

where:

| | | |
|---|---|---|
| $\delta\phi_K$ | = | Change in rotation angle of mechanical degree of freedom (for turntable 14) for current sample period k |
| $\delta\phi_{K-1}$ | = | Change in rotation angle of mechanical degree of freedom for sample period K-1 |
| SQerror | = | Signal Quality (or BER) error = SQ − $SQ_{reference}$ |
| $SQerror_k$ | = | Signal Quality (or BER) error for current sample (K) |
| $SQerror_{k-1}$ | = | Signal Quality (or BER) error for sample K-1 |
| $SQerror_{k-2}$ | = | Signal Quality (or BER) error for sample K-2 |
| $K_{it}$ | = | Integral gain constant |
| $K_p$ | = | Proportional gain constant |
| $K_{dt}$ | = | Derivative gain constant |
| T | = | Time Interval between SQ samples |

6. An apparatus for controlling the position of an electronically steerable, mechanically augmented phased array (MAPA) antenna disposed on a moving platform to cause said MAPA antenna to track a primary signal source in a manner so as to reduce interference from one or more interfering signal sources operating within a coverage area of said MAPA antenna, the apparatus comprising:

a rotatable structure for mounting said MAPA antenna thereon;

a motor for rotating said rotatable structure;

a receiver/decoder for receiving signals from said MAPA antenna and generating therefrom signal quality signals representative of a quality of said signals received by said MAPA antenna; and a system phased array controller responsive to said signal quality signals for generating motor control signals applied to said motor for positioning an aperture of said MAPA antenna such that a boresight thereof is directed away from said primary signal source, to thereby reduce a signal quality of a received signal to below an optimum level, and electronically steering a said MAPA antenna toward said primary signal source while maintaining said aperture directed away from said boresight, to thereby maximize a total carrier-to-noise-plus-interference (CNI) ratio of said signals received by said MAPA antenna.

7. The apparatus of claim 6, wherein said system phased array controller, said MAPA antenna and said receiver/decoder comprise a closed loop system for controlling mechanical positioning of said MAPA antenna in real time.

8. The apparatus of claim 6, wherein said system phased array controller determines said motor control signals in accordance with a formula:

$$\delta\Phi=K_{it}SQ_K+K_p\delta SQ_K+K_{dt}\ (\delta SQ_K-\delta SQ_{K-1})$$

where:

| | | |
|---|---|---|
| $\phi_{tt}$ | = | rotation angle of mechanical degree of freedom (turntable); |
| $\delta\phi_m$ | = | change in rotation angle of mechanical degree of freedom (motor); |
| $K_{it}$ | = | integral gain constant; |
| $SQ_K$ | = | Signal Quality (or BER) for time interval K; |
| $K_p$ | = | proportional gain constant; |
| $\delta SQ_K$ | = | first derivative of Signal Quality (or BER) for time interval K; |
| $K_{dt}$ | = | derivative gain constant; and |
| $\delta SQ_{K-1}$ | = | first derivative of Signal Quality (or BER) for time interval K-1. |

9. A method for positioning an electronically steerable, mechanically augmented phased array (MAPA) antenna on an moving platform such as an aircraft or ship to track a primary signal source in a manner so as to reduce interference relative to one or more interfering signal sources operating within a coverage area of said MAPA antenna, and wherein the positions of said interfering signal sources are known in advance of said moving platform entering said coverage area, the method comprising:

providing a look-up table including a plurality of optimal antenna position values based on known longitudinal and latitudinal positions of said interfering signal sources, said optimal antenna position values for said MAPA antenna intended to maximize a carrier-to-noise-plus-interference ratio of a signal received by said MAPA antenna;

determining in real time a longitude and a latitude of said moving platform and generating longitude and latitude position values in accordance therewith;

disposing said MAPA antenna on a structure able to be rotated and receiving signals from said primary signal source;

using said longitude and latitude values to determine from said look-up table a particular optimal antenna position value; and rotating said MAPA antenna to a position in accordance with said particular optimal antenna position value to thereby minimize interference from said interfering signal sources.

10. The method of claim 9, wherein said step of disposing said MAPA antenna on a structure to be rotated comprises the step of disposing said antenna on a turntable.

11. The method of claim 10, wherein said step of rotating said MAPA antenna comprises the step of using a motor for driving said turntable.

12. A method for positioning a electronically steerable, mechanically augmented phased array (MAPA) antenna disposed on a moving platform to track a primary satellite transponder in a manner so as to reduce interference relative to an interfering or interfered with satellite transponder operating within a coverage area of said MAPA antenna, and wherein it is assumed that said interfering or interfered with satellite transponder lies approximately along a line normal to a geostationary arc at the longitude of said primary satellite transponder, the method comprising:

disposing said MAPA antenna on a structure able to be rotated;

communicating a signal between said primary signal source and said MAPA antenna;

determining said normal line;

moving an aperture of said MAPA antenna such that a face thereof is directed away from said primary signal source and such that said MAPA antenna aperture is positioned to minimize interference relative to said interfering or interfered with satellite transponder; and while said face is directed away from said primary signal source, causing a beam of said MAPA antenna to be electronically steered back to track said primary signal source.

* * * * *